United States Patent [19]

Brutting

[11] 4,044,479

[45] Aug. 30, 1977

[54] SHELL SOLE

[75] Inventor: Eugen Brütting, Nurnberg, Germany

[73] Assignees: EB Sport International GmbH vormals; Heiner Stuhfauth GmbH, Germany

[21] Appl. No.: 658,130

[22] Filed: Feb. 13, 1976

[30] Foreign Application Priority Data

Feb. 15, 1975 Germany ..... 2506530

[51] Int. Cl.[2] ..... A43B 13/04

[52] U.S. Cl. ..... 36/32 R

[58] Field of Search ..... 36/32 R, 14, 25 R, 29

[56] References Cited

U.S. PATENT DOCUMENTS

| | | | |
|---|---|---|---|
| 1,735,986 | 11/1929 | Wray | 36/14 |
| 2,527,414 | 10/1950 | Hallgren | 36/32 R |

FOREIGN PATENT DOCUMENTS

| | | | |
|---|---|---|---|
| 728,547 | 4/1932 | France | 36/32 R |
| 1,128,134 | 8/1956 | France | 36/32 R |
| 1,494,331 | 7/1967 | France | 36/32 R |
| 1,962,236 | 6/1971 | Germany | 36/32 R |
| 544,500 | 6/1956 | Italy | 36/32 R |

*Primary Examiner*—Alfred R. Guest
*Attorney, Agent, or Firm*—Craig & Antonelli

[57] ABSTRACT

Shell sole construction for footwear comprised of a sole bottom portion, an upwardly rising edge portion extending around the outer edge of the sole bottom and, optionally including a cutout or recess in the bottom of the shell sole for receiving insert bottoms, is provided with a plurality of longitudinally distributed predetermined bending zones or points along the upwardly rising edge of the shell sole in the area of the ball of the foot to achieve a reduction in the bending stress exerted on the shell sole in the region of the ball of the foot.

27 Claims, 5 Drawing Figures

FIG. 1
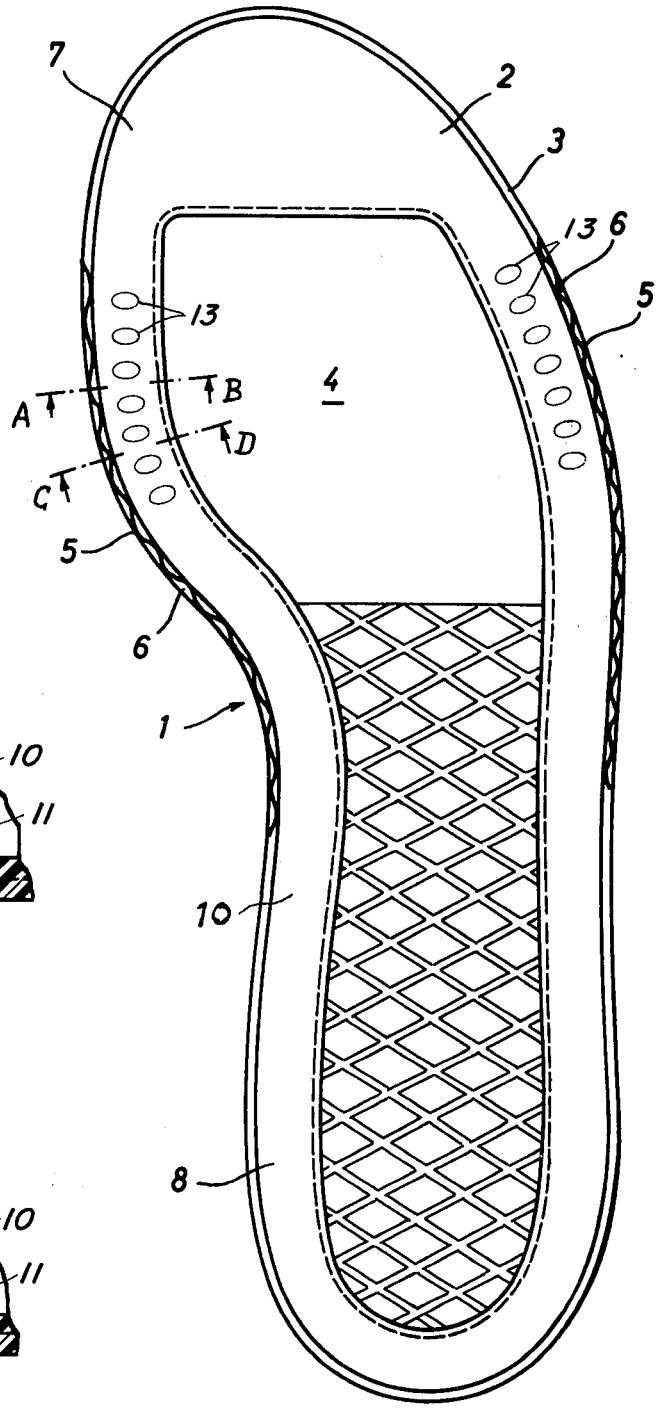
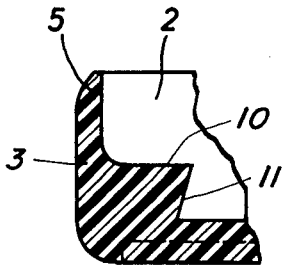
FIG. 4
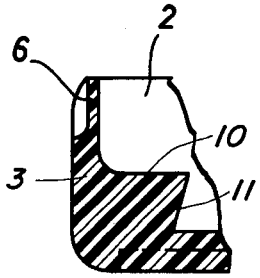
FIG. 5

SHELL SOLE

BACKGROUND AND SUMMARY OF THE INVENTION

This invention relates to a shell sole for footwear, especially sport shoes, having an edge rising above the inner sole surface, the inside of this edge encompassing the outer edge zone of the shank and being glued or cemented or otherwise connected thereto.

Shell soles of various types and differing structure have heretofore been proposed. They are utilized particularly in sport shoes, since, due to the upwardly rising edge zone of the shell sole, sole material is still brought in contact with the ground even if the shoe rests thereon in an inclined position, and thus an improved grip is obtained. Further advantages of employing shell soles reside in the possibility of a more intimate gluing or other bonding to the shank.

These shell soles, however, also suffer from various disadvantages. Thus, the sole must have a certain strength and/or thickness to prevent small stones and the like from exerting their pressure all the way through the sole to the foot. This results in a relatively hard or thick design of the sole, which renders the latter heavy and relatively resistant to bending. The bending resistance is increased especially by the upwardly rising edge of the shell sole. However, particularly in the case of sport shoes, it is desirable to produce a lightweight shoe which even under considerable dynamic pressure stress will protect the foot from pressure impacts from the sole side, occurring over small areas. Moreover, a sport shoe should be able to follow as closely as possible the motion of the foot, which is of importance especially in the various types of running sports.

Weight and good bending of flexible properties, on the one hand, and the pressure distribution characteristic and firm hold or traction of the shoe even when set on the ground in an inclined position, on the other hand, thus result in the necessity of simultaneously meeting different requirements for the shell sole, notwithstanding the aforementioned conflicting considerations.

It is, therefore, one subject of the present invention to provide shell soles of the type described hereinabove evidencing the advantages of a good grip on the floor even when the shoe is in an inclined position and an improved connection or adherence with the shank or upper, without incurring the disadvantages of heretofore proposed shell soles wherein the sole is heavy and resistant to bending and suffers damage, particularly with respect to the bond between the shell and the shank in the edge zone.

The above object as well as other objects and features of the invention are attained by providing several longitudinally distributed predetermined bending, buckling, or flexing zones or points along the edge of the shell sole in the area of the ball of the foot.

In accordance with the present invention, the rigidifying effect of the edge projecting vertically above the sole bottom is reduced in the primary deformation area, namely in the zone of the ball of the foot. Moreover, the appearance of locally restricted bends in the inner and outer ball area, occurring at the same spots, is counteracted by providing a plurality of "predetermined bending points" which are distributed in the longitudinal direction of the sole edge. In other words, the deformation movement which heretofore manifested itself in a correspondingly deep kink always occurring at the same location, is distributed over a greater area. As a result, the mechanical stress on the connection or bond between the edge of the shell sole and the shank is distributed over a larger area, whereby the specific loads or stresses thereon are reduced and a longer lifetime is obtained for this bond. Moreover, the pressure stress acting on the foot due to the bend or kink formation is correspondingly distributed as well.

In one of the preferred embodiments, the predetermined bending points or zones are established or formed by relatively thin wall portions of the material remaining between webbed portions or sections or stress alleviating inserts provided according to the invention along the upwardly rising edge zone of the shell sole formed so that they terminate approximately perpendicularly to the plane of the sole. The webs thus impart strength to the sole in the edge zone, whereas the thin-walled portions of material remaining therebetween are deformed under the bending motion and/or can also be buckled in the direction toward the shank, depending on the material and the bond. Since the shank materials are generally comprised of a material which lends itself to a buckling to a lesser extent than the shell sole, such as leather, textile materials, and correspondingly soft plastics, the bond between the inside of the shell sole edge and the shank is exposed only to minor stresses during the rolling motion of the foot. The connecting layer, for example, an adhesive or the material of the shell sole proper, is likewise capable of bending or buckling.

In another preferred embodiment of the invention, the webs are formed to taper in the upward direction; tapering may be with respect to the thickness of the webs approximately vertically to the shank surface and/or also in the longitudinal direction of the edge with respect to the width of the webs. In the latter case there remain between the webs approximately triangular shaped zones of reduced thickness of material, As emphasized above, the greatest bending stresses occur during the rolling motion of the foot in the zone of the ball thereof. However, also toward the zone of the toe and toward the heel zone the sole is correspondingly deformed, so that in certain embodiments, these predetermined bending points or buckling zones may extend fron the end of the toe region to the beginning of the heel region and preferably in the inner as well as outer ball zones.

A further embodiment of the shell sole directed to solving the aforementioned problem resides in forming a cutout or recess in the area of the shoe bottom of the shell sole. Depending on the purpose of the shoe associated with the shell sole, shoe bottom parts of various material characteristics can be inserted in this cutout. This affords the possibility of producing the shell sole proper of a relatively rugged and/or bending-resistant material, so that a good pressure distribution is ensured even with a thin sole design with regard to ground unevennesses, such as stones and the like. In contrast thereto, the insert sole bottom or bottom inserts may be made of a relatively soft and/or also lightweight material offering only a minor resistance to the bending or twisting of the sole during the rolling motion of the foot. With the insert, the sole in total has, in spite of the relatively firm material for the outer sole, only a minimal bending resistance, especially in conjunction with the above-described constructions of the edge zone of the shell sole.

The possibility of inserting, in the cutout of the sole bottom, insert sole bottoms of different material and properties which can be, depending on the ultimate intended purpose of use for the shoe, more or less soft, perspiration-absorbing, lightweight, elastic, shock-absorbing, and the like, furthermore has the special advantage that the same mold can be used for manufacturing shell solves having, due to the utilization of differing materials, correspondingly different characteristics. Therefore, with only a single shell mold, quite a large array of requirements can be met for sport shoes intended for a great variety of types of sports. This is of special economical significance, considering that the mold for such shell soles is relatively quite expensive.

The cutout when present need not extend over the entire bottom of the shoe and it is possible to provide individual recesses in the ball and/or heel zones. It is likewise possible to subdivide the insert sole bottoms, i.e., to insert materials with different characteristics in different regions of the sole. In a preferred embodiment, the cutout extends over the entire bottom of the shoe, except for a marginal zone which preferably is of approximately the same width all around. Basically different inserts extending over certain regions of the cutout can be introduced into such a cutout. In view of the stresses, which occur, and also economical considerations, however, it will usually be desirable to make do with a single material for the insert. For similar reasons, in another preferred embodiment, the cutout is of approximately the same depth over its entire expansion as seen when viewed perpendicularly to the bottom of the shoe. Such a construction is not absolutely required and, therefore, it is possible, especially when subdividing the cutout into different zones, to provide differing depths. Also, the heel portion of the shell sole, which is normally fashioned to be thicker, will be rendered lightweight by providing a honeycomb-like structure, for example, from the wear zone of the thread sole upwards to the underside of the insert. Also with a view toward a reduction in weight and, additionally, a further reduction in weight and, additionally, a further reduction in bending resistance, it is possible to arrange recesses in the marginal zone of the shoe bottom encompassing the cutout, which recesses are likewise extended preferably to the wear zone of the tread sole. These recesses can have varying configurations; for example, they can be vertically extending holes with defined edges, or also zig-zag-shaped recesses, and the like.

Another preferred embodiment resides in that the edges of the cutout are made to be undercut, at least in certain regions. Thus, an insert sole bottom can then be readily placed into the correct position and can be sufficiently fixed in position for use without any further fastening means due to this wedge-shaped and/or half-dovetail-like holding arrangement.

The webbed portions or stress alleviating inserts of the invention which provide the shell sole with longitudinally distributed predetermined bending or flex points may be derived from the same or different material as the shell sole and/or shank including natural, or artificial leather, flexible plastics, textiles, rubber and the like. Moreover, the web portions may be molded or otherwise formed integrally with the edge zone of the shell sole or may be formed separately as an insert or underlay prior to completion of the edge zone.

Other objects, features and advantages of the invention will be apparent to those skilled in the art by reference to the attached drawings and detailed description of the invention which follows.

BRIEF DESCRIPTION OF THE DRAWINGS

FIG. 1 shows a top view of the inner shoe side of one embodiment of the shell sole;

FIGS. 4 and 5 show enlarged sectional views of the sections along lines A–B and C–D of FIG. 1.

DESCRIPTION OF THE PREFERRED EMBODIMENTS

Referring to FIG. 1, the shell sole, denoted in its entirety by 1, consists of the shoe bottom, denoted in its entirety by 2; the upwardly directed surface of this shoe bottom, facing the inside of the shoe, is surmounted in a conventional manner by an edge 3 extended around the shoe bottom at the outer edge thereof. The inside of the edge 3 encloses, in the finished condition of the shoe, a corresponding lower edge portion of the shank and is connected to the latter at 12 corresponding to the top or foot side of the shell sole. The shank, which is optionally gusseted with an inner finishing sole, can be finished by molding the shell sole, made of a synthetic resin, for instance, around the shank, thus obtaining a certain adhesion between the synthetic resin of the shell sole and the shank material; however, the shell sole can also be glued or heat bonded to the shank. In either case, there has been the disadvantage heretofore that a bending zone was created in the inner and outer ball regions — especially in case of a corresponding bending in the ball zone 4 — with the result that bending always occurred at the same spot. As a consequence, the edge of the shell sole had to be considerably deformed at that location, entraining the shank material adhering thereto, causing lateral rupturing or chunking. This resulted in damage, particularly with regard to the connection between the edge of the shell sole and the shank in the region of the bending point.

Figure 3:
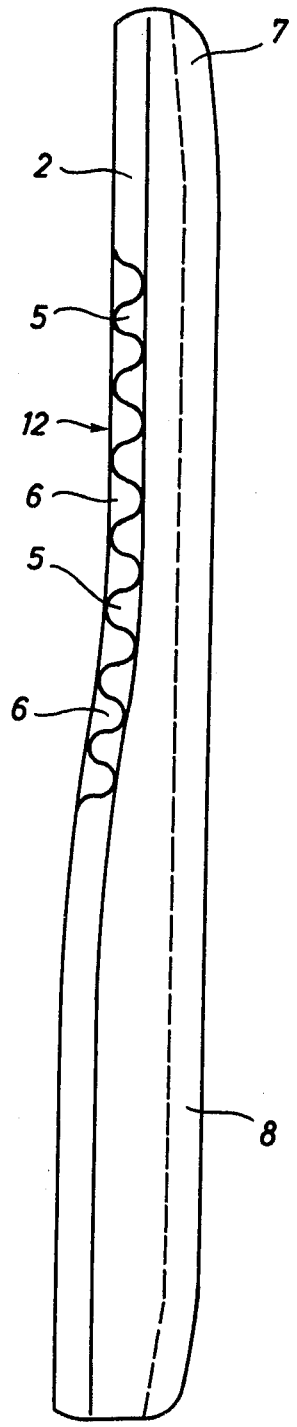
FIG. 3 shows a lateral view of the shell sole of FIG. 1.

In accordance with the embodiment illustrated in the drawings, a single bending point is avoided by providing a plurality of weakened edge zones in the marginal region of the edge which projects upwardly. The plurality of weakened edge zones are distributed in the longitudinal direction of the edge region approximately between the beginning of the heel zone and the end of the toe zone, but especially over the outer and inner ball regions. As a consequence thereof, rather than a sharp bend, a plurality of slight deformations occurs during the rolling motion and the corresponding twisting of the of the shell sole, and the bending stresses observed specifically with respect to such a plurality of a predetermined bending points are minor. In the present embodiment of the invention, these predetermined bending points are provided by forming, in the upwardly projecting marginal zone of the edge of the shell sole, as seen in the longitudinal direction, webs 5 which are arranged at specific predetermined spacings and tapered in the region of the upper termination of the edge. Between these webs, there remain thinner zones of the edge material in the form of wall portions 6. The latter approximate the shape of triangles oriented with their apices toward the bottom of the sole. The webs 5 not only taper widthwise as seen in the longitudinal direction of the edge extension, but also with respect to their thickness as seen perpendicularly to the edge area. The aforementioned features of the webs 5 and wall portions 6 are shown especially in FIGS. 3–5.

The predetermined breaking points extending in the outer and inner ball regions between the toe zone 7 and the heel zone 8 of the shell sole not only prevent the formation of a locally very restricted bend with a correspondingly high stress on the material, but also reduce the bending resistance of the sole in total. The thin wall portions 6 remaining between the webs 5 moreover can be buckled to a certain extent, as is also the case with the shank material, so that a lateral rupturing of the shell sole and/or shank can be almost entirely avoided.

An additional feature for still further reducing the bending resistance of the shell sole is the provision of a cutout 9 in the bottom of the shoe. This cutout may be filled with insert bottoms possessing great variety of material characteristics, depending on the type of sport shoe to be manufactured with the shell sole of the invention. Accordingly, the possibility is afforded of maintaining satisfactory pressure distribution and reduced stress on the shoe sole which itself is correspondingly rigid and/or heavy, in that a material of lower rigidity and/or weight can be inserted in the cutout.

The cutout extends, in the present embodiment, over a major part of the shoe bottom; only the toe zone is preserved as a solid bottom. The edge strip 10 of the shell sole bottom which otherwise extends around the cutout is of approximately the same width and can be provided with recesses in the zone of greater deformations, reducing the bending resistance of the marginal strip. These recesses have not been illustrated; they preferably extend deep into the shoe bottom, namely practically up to the sole wear plane.

Figure 2:
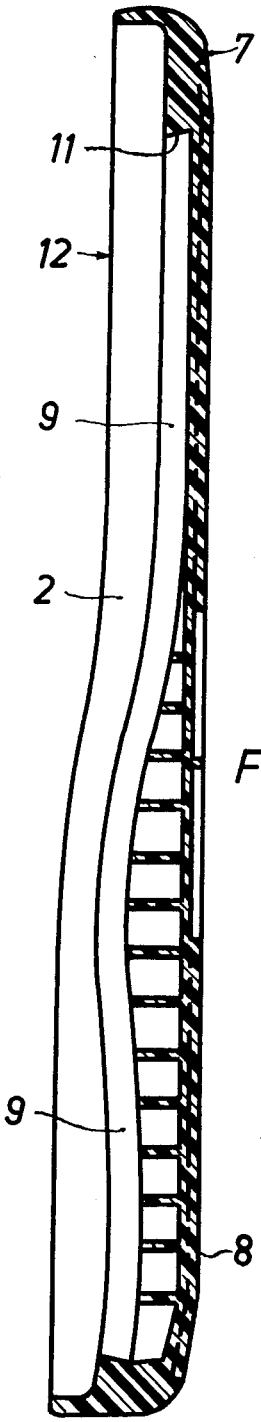
FIG. 2 shows a lateral view of a section through the sole axis.

As can be seen, in particular, from FIGS. 2, 4 and 5, the edge 11 of the cutout 9 is fashioned to be undercut so that an insert bottom, in the inserted condition, will be sufficiently held due to this undercut edge formation, and needs no additional fastening means. Normally, the insert bottom, the edge strip and the toe region of the shoe sole bottom are additionally covered by an inner sole.

As shown in FIG. 2, the shell sole bottom in the heel zone and, in part, also in the joint region is formed by a highly arched sole bottom arrangement formed with minimum use of materials. This is a conventional honeycomb structure covered by the insert bottom which can placed into the cutout. In this arrangement, it is of course possible to also provide intermediate layers which absorb specifically high compressive stresses. In the present illustration, the height of the cutout viewed perpendicularly to the surface of the sole is uniform throughout which facilitates the manufacture of the insert bottom or bottoms.

While the invention has been described and pointed out with reference to certain specific embodiments thereof, those skilled in the art will appreciate that various changes, modifications and substitutions can be made without departing from the spirit of the invention. It is intended, therefore, that the invention be limited only be the scope of the claims which follow.

What is claimed is:

1. A unitary shell sole for footwear comprising a sole bottom portion providing a base for a tread sole portion, an upwardly rising edge portion extending around the periphery of the sole bottom at the outer edge thereof, and a plurality of longitudinally distributed predetermined bending points along said edge portion, said plurality of bending points being constituted by a plurality of spaced relatively thin-walled portions in said edge portion.

2. The shell sole according to claim 1, wherein said edge portion includes a plurality of web portions separating and connecting respective ones of said plurality of spaced thin-walled portions, said web portions having relatively thicker walls than said thin-walled portions.

3. The shell sole according to claim 2, wherein said thin-walled portions extend approximately vertically to the plane of said sole bottom.

4. The shell sole according to claim 3, wherein said webbed portions taper in a vertical direction with respect to the thickness thereof.

5. The shell sole according to claim 4, wherein said webbed portions taper in a vertical direction with respect to the width thereof.

6. The shell sole according to claim 5, wherein said thin-walled portions are configured in generally triangular shapes having apices oriented in the direction of said sole bottom.

7. The shell sole according to claim 6, wherein said plurality of longitudinally distributed predetermined bending points occur in the ball region of the foot.

8. The shell sole according to claim 6, wherein said plurality of longitudinally distributed predetermined bending points extend from the end of the toe region to the beginning of the heel region of said sole bottom.

9. The shell sole according to claim 3, wherein said sole bottom is further provided with a cutout portion for receiving preselected insert sole bottoms.

10. The shell sole according to claim 9, wherein said cutout is of substantially equivalent depth over the entire extension of said cutout.

11. The shell sole according to claim 9, wherein said cutout portion encompasses an area less than the total horizontal surface area of the sole bottom leaving a non-cutout marginal zone on said sole bottom.

12. The shell sole according to claim 11, wherein said marginal zone of said sole bottom is provided with a plurality of recesses in the region corresponding to the inner and outer ball portions of the ball area of the foot, said recesses extending approximately to a layer of said sole bottom corresponding to the wear surface thereof.

13. The shell sole according to claim 9, wherein said cutout includes edge portions which are undercut in preselected areas thereof.

14. The shell sole according to claim 9, wherein said cutout portions receives insert sole bottoms derived from a material different from that of said shell sole and having properties differing therefrom.

15. The shell sole according to claim 2, wherein said sole bottom is further provided with a cutout portion for receiving preselected insert sole bottoms.

16. The shell sole according to claim 15, wherein said cutout portion encompasses an area less than the total horizontal surface area of the sole bottom leaving a non-cutout marginal zone on said bottom, and said cutout is of substantially equivalent depth over the entire extension of said cutout.

17. The shell sole according to claim 16, wherein said thin-walled portions are configured in generally triangular shapes having apices oriented in the direction of said sole bottom.

18. The shell sole according to claim 2, wherein said webbed portions taper in a vertical direction with respect to the thickness thereof.

19. The shell sole according to claim 2, wherein said webbed portions taper in a vertical direction with respect to the width thereof.

20. The shell sole according to claim 1, wherein said thin-walled portions extend approximately vertically to the plane of said sole bottom.

21. The shell sole according to claim 1, wherein said thin-walled portions are configured in generally triangular shapes having apices oriented in the direction of said sole bottom.

22. The shell sole according to claim 1, wherein said plurality of longitudinally distributed predetermined bending points occur in the ball region of the foot.

23. The shell sole according to claim 1, wherein said plurality of longitudinally distributed predetermined bending points extend from the end of the toe region to the beginning of the heel region of said sole bottom.

24. The shell sole according to claim 1, wherein said sole bottom is further provided with a cutout portion for receiving preselected insert sole bottoms.

25. The shell sole according to claim 24, wherein said cutout portion encompasses an area less than the total horizontal surface area of the sole bottom leaving a non-cutout marginal zone on said bottom, and said cutout is of substantially equivalent depth over the entire extension of said cutout.

26. The shell sole according to claim 24, wherein said marginal zone of said sole bottom is provided with a plurality of recesses in the region corresponding to the inner and outer ball portions of the ball area of the foot, said recesses extending approximately to a layer of said sole bottom corresponding to the wear surface thereof.

27. The shell sole according to claim 1, in combination with a shoe shank, wherein said upwardly rising edge portion encompasses the outer edge of said shank and is relatively permanently attached thereto to form an article of footwear.

* * * * *